US005100001A

United States Patent [19]

Brooks

[11] Patent Number: 5,100,001

[45] Date of Patent: Mar. 31, 1992

[54] TRAY WITH PLATE FASTENER

[76] Inventor: James T. Brooks, 1024 Abilene Ct., Hamilton, Ohio 45013

[21] Appl. No.: 704,110

[22] Filed: May 22, 1991

[51] Int. Cl.[5] ..... B65D 1/34; A47B 85/00

[52] U.S. Cl. ..... 206/560; 206/564; 206/478; 206/493; 108/26

[58] Field of Search ..... 206/560, 564, 493, 478; 108/25, 26

[56] References Cited

U.S. PATENT DOCUMENTS 2,684,110 7/1954 Stone ..... 108/26 X
3,432,026 3/1969 O'Leary ..... 206/478 X
4,908,066 3/1990 Taylor et al. ..... 108/26
5,010,826 4/1991 Kudlac ..... 206/564 X

FOREIGN PATENT DOCUMENTS 432510 8/1926 Fed. Rep. of Germany ..... 108/26

*Primary Examiner*—William I. Price
*Attorney, Agent, or Firm*—H. Jay Spiegel

[57] ABSTRACT

A tray is disclosed which includes structure designed to allow secure holding of a plate thereon. The tray is provided with a recess or opening designed to receive the central portion of a plate therein. The plate has two opposed slots, each of which is intended to receive a strap which is fixed to the tray. Each strap is extended through a slot in the plate and is doubled back upon itself and fastened using a suitable fastener.

8 Claims, 1 Drawing Sheet

TRAY WITH PLATE FASTENER

BACKGROUND OF THE INVENTION

The present invention relates to a tray with plate fastener. In the prior art, trays having fastening means for various objects are known. However, Applicant is unaware of any prior art teaching a tray having all of the aspects and features of the present invention.

The following prior art is known to Applicant:

U.S. Pat. No. 1,609,671 to Steuart discloses a tray having a plurality of different fastening devices having clip structure as best seen in FIG. 2 thereof. The present invention differs from the teachings of Steuart as including a recess for the central portion of a plate and strap fasteners interacting with slots formed in the plate.

U.S. Pat. No. 2,103,578 to Ford discloses a base 10 having upstanding supports 12 for merchandise. This patent is believed to be of only general interest concerning the teachings of the present invention.

U.S. Pat. No. 2,659,486 to Krupin discloses a tray having a clip best seen in FIG. 4 thereof. The present invention differs from the teachings of this patent for the same reasons as set forth concerning the Steuart patent.

U.S. Pat. No. 2,811,251 to Yerkovich discloses a tray having fastening means designed to fasten a cassette thereon, which fastening means is best seen with reference to FIG. 2. Yerkovich fails to teach the strap fasteners or slots of the present invention.

U.S. Pat. No. 3,102,728 to Booth discloses a tray having a plurality of clips thereon designed to allow fastening of cards therein. While Booth teaches the recesses 6 as best seen in FIGS. 1 and 2, these recesses are not centrally located on the tray and are not intended to support a structure which extends outside the recesses and, furthermore, Booth fails to teach the particular fastening means disclosed herein.

SUMMARY OF THE INVENTION

The present invention relates to a tray with plate fastener. The present invention includes the following interrelated objects, aspects and features:

(a) In a first aspect, the invention is intended to incorporated into a tray of the type which is normally used with a "high chair".

(b) The high chair tray is improved by adding a central recess or opening sized and configured to receive the central portion of a plate. Most plates include a generally circular central downwardly extending lip designed to support the plate on a flat surface. The recess or opening is sized and configured to receive this portion of the plate.

(c) In order to allow fastening of the plate to the tray, the plate is provided with two diametrically opposed slots. These slots are sized and configured to allow receipt of fastening straps.

(d) Each fastening strap has one end fastened to the tray and includes hook and pile fastening means such as that which is manufactured and marketed under the trademark VELCRO, so that each strap may be fastened in a loop-like configuration extending through a slot in the plate so that the straps securely hold the plate with the downwardly extending lip thereof within the recess or opening.

As such, it is a first object of the present invention to provide a tray with plate fastener.

It is a further object of the present invention to provide such a device wherein the tray is provided with a recess or opening designed to receive a downwardly extending lip of a plate.

It is a yet further object of the present invention to provide such a device including fastening straps designed to fasten the plate to the tray.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
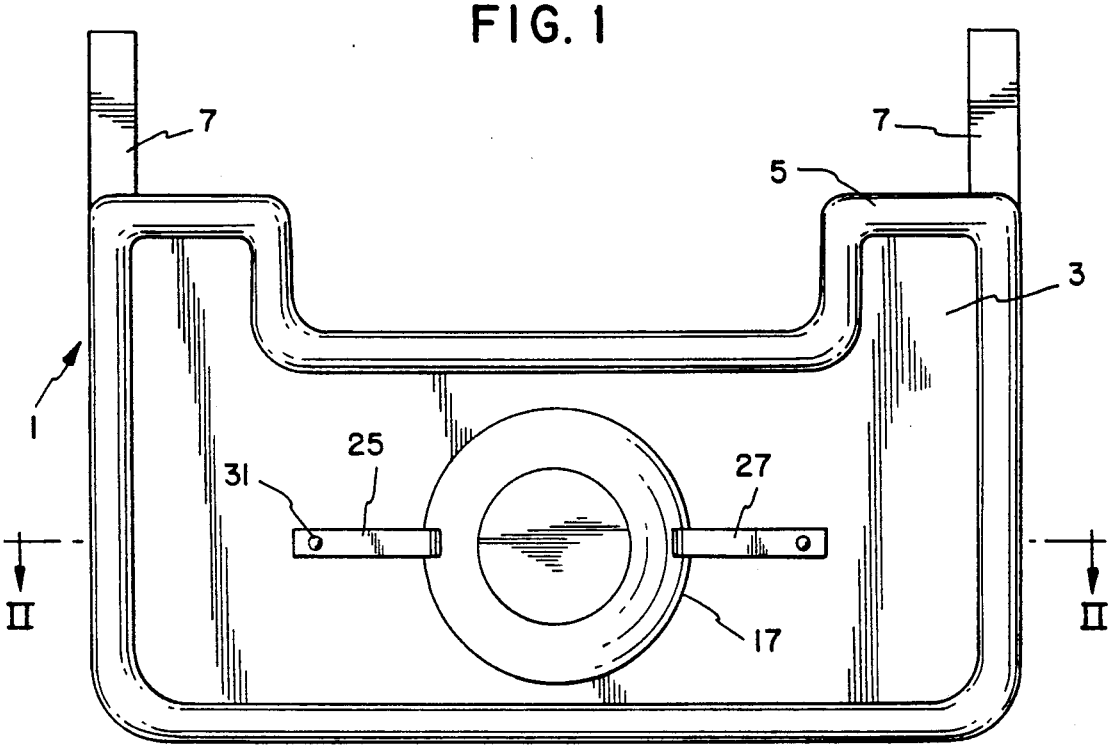
FIG. 1 shows a top view of the present invention.

With reference to the figures, the tray is generally designated by the reference numeral 1 and is seen to include a body 3 having a peripheral upstanding lip 5 designed to prevent spills from leaving the tray.

Fastening rods 7 are provided to allow fastening of the tray 1 to a high chair or other chair.

Figure 2:
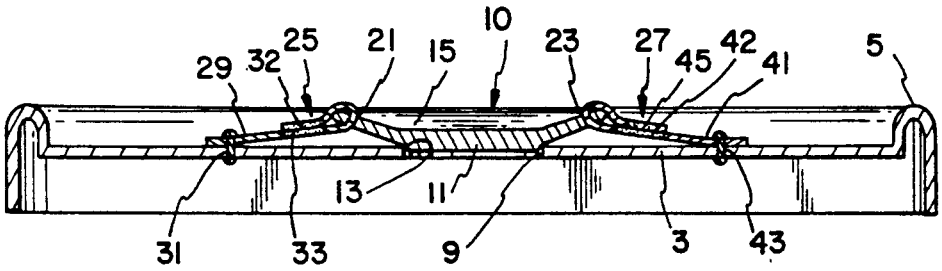
FIG. 2 shows a cross-sectional view along the line II—II of FIG. 1.

With particular reference to FIG. 2, it is seen that an opening 9 is centrally formed in the tray body 3, although a recess or indentation may be provided instead of the opening 9. The purpose for the opening 9 (or recess or indentation) is to provide a location where a plate may be securely received.

With further reference to the figures, a plate 10 is seen to include a base 11 having a peripheral downwardly extending lip 13 sized and configured to be received within the opening 9. The plate has an eating surface 15 and a periphery 17.

With further reference to the figures, two diametrically opposed slots 21 and 23 are formed in the plate 10, for a purpose to be described in greater detail hereinafter. Straps 25 and 27 are mounted on the tray 1. The strap 25 has a first end 29 with a rivet 31 or screw fastening the end 29 through the tray base 3. The strap 25 includes hook and pile fastening means 33 with one half of this fastening means 33 being located adjacent the end 29 and with the other half being located on the end 32 of the strap 25.

The strap 27 has an end 41 attached to the tray base 3 by a rivet 43 or screw or other suitable fastening means. The strap 27 has hook and pile fastening means 45 with one half of the hook and pile fastening means 45 being adjacent the end 41 of the strap 27 and with the other half of the hook and pile fastening means being at the end 42 of the strap 27.

As best seen in FIG. 2, the strap 25 extends through the slot 21 in the plate 10 and is fastened upon itself using the hook and pile fastening means 33. Similarly, the strap 27 extends through the slot 23 in the plate 10 and is fastened upon itself using the hook and pile fastening means 45.

As such, based upon the above description, the operation of the present invention should be well understood. When it is desired to attach a plate to the tray 1, the plate 10, with slots 21, 23 is placed on the tray 1 with the downwardly extending lip 13 thereof extending within the opening 9 (or recess or indentation). The straps 25, 27 are extended through the respective slots 21, 23 and are fastened upon themselves using the respective hook and pile fastening means 33, 45 to securely fasten the plate 10 in secure mounted position on the tray 1. In this position, an infant sitting on the associated high chair or seat (not shown) will not be able to overturn the plate 10, thus providing a safe and effective way of allowing an infant to eat without fear of spills or damage.

As such, an invention has been disclosed in terms of a preferred embodiment thereof which fulfills each and every one of the objects of the invention as set forth hereinabove and provides a new and useful tray with plate fastener of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. In a tray having a base, the improvement comprising:

a) a plurality of straps mounted on said base;

b) a plate having a periphery and a plurality of slots adjacent said periphery;

c) said plate being adapted to be fastened on said tray with each slot receiving therethrough one of said straps;

d) each strap being fastened to securely mount said plate on said tray.

2. The invention of claim 1, wherein said slots are diametrically opposed.

3. The invention of claim 1, wherein each strap has a fastener whereby said strap is fastenable upon itself in a loop-like configuration.

4. The invention of claim 3, wherein said fastener comprises hook and pile fastening means.

5. The invention of claim 1, wherein said tray includes a recess therein between said straps, said plate having a downwardly depending lip sized and configured to be received in said recess.

6. The invention of claim 5, wherein said recess comprises an opening.

7. The invention of claim 1, wherein said tray includes a peripheral lip.

8. The invention of claim 1, wherein each said strap is mounted on said tray with a rivet or screws.

* * * * *